US010549826B1

(12) United States Patent
Castro

(10) Patent No.: US 10,549,826 B1
(45) Date of Patent: Feb. 4, 2020

(54) FLOATATION APPARATUS AND METHOD

(71) Applicant: William S. Castro, Edison, NJ (US)

(72) Inventor: William S. Castro, Edison, NJ (US)

( * ) Notice: Subject to any disclaimer, the term of this patent is extended or adjusted under 35 U.S.C. 154(b) by 0 days.

(21) Appl. No.: 16/159,157

(22) Filed: Oct. 12, 2018

(51) Int. Cl.
*B63C 9/08* (2006.01)

(52) U.S. Cl.
CPC ..... *B63C 9/08* (2013.01)

(58) Field of Classification Search
CPC ..... B63C 9/08
USPC ..... 441/129, 130; 482/55, 111
See application file for complete search history.

(56) References Cited

U.S. PATENT DOCUMENTS 4,768,774 A * 9/1988 Beasley ..... A63B 21/0084 441/129
6,482,058 B2 * 11/2002 Sanso ..... A63B 67/007 440/101
6,843,695 B1 * 1/2005 Jackson ..... A61H 3/008 441/129
7,955,226 B2 * 6/2011 Dauben ..... A63B 31/00 441/129
8,628,366 B2 * 1/2014 Pope ..... B63B 35/73 441/129
2012/0164899 A1 * 6/2012 Pope ..... B63B 35/73 441/129

* cited by examiner

*Primary Examiner* — Anthony D Wiest
(74) *Attorney, Agent, or Firm* — Walter J. Tencza, Jr.

(57) ABSTRACT

An apparatus including a first and second floatation members; a first and second handle devices fixed at first ends to the first and second floatation members, respectively; and an intermediate member. The first floatation member may be connected to the second floatation member by the intermediate member, so that there is a region between the first and second floatation members, and behind the intermediate member. The first and second handle devices may be configured to be situated below the surface of water, when the first and second floatation members are floating substantially parallel to and on the surface of the water. The apparatus may be configured so that a person can stand upright in the region and simultaneously grip the first and second handle devices, with left and right hands, respectively, while the first and second floatation members float, substantially parallel to and on the surface of the water.

14 Claims, 7 Drawing Sheets

FLOATATION APPARATUS AND METHOD

FIELD OF THE INVENTION

This invention relates to floatation methods and devices.

BACKGROUND OF THE INVENTION

There are various devices or methods known for helping people to float or move more easily while in a swimming pool or in the ocean. However, these devices or method are not adequate, particularly for individuals with various disabilities.

SUMMARY OF THE INVENTION

In at least one embodiment, an apparatus is provided comprising a first floatation member; a second floatation member; a first handle device fixed at a first end to the first floatation member; a second handle device fixed at a first end to the second floatation member; and an intermediate member. The first floatation member may be connected to the second floatation member by the intermediate member, so that there is a region between the first floatation member and the second floatation member, and behind the intermediate member.

The first handle device and the second handle device may be configured to be situated below the surface of water, when the first floatation member and the second floatation member are floating substantially parallel to and on the surface of the water.

The apparatus may be configured so that a person can stand upright in the region and simultaneously grip the first and second handle devices, with first and second hands, respectively, while the first floatation member and the second floatation member float, substantially parallel to and on the surface of the water.

The first handle device may be substantially perpendicular to the first floatation member; and the second handle device may be substantially perpendicular to the second floatation member.

The first end of the first handle device may be fixed to a location between first and second ends of the first floatation member, and nearer the first end of the first floatation member, and a second end of the first handle device may be fixed to first tubing which is fixed to the second end of the first floatation member, and wherein the first tubing, first handle device, and at least part of the first floatation member form a first closed loop.

The first end of the second handle device may be fixed to a location between first and second ends of the second floatation member, and nearer the first end of the second floatation member, and a second end of the second handle device is fixed to second tubing which is fixed to the second end of the second floatation member, and wherein the second tubing, second handle device, and at least part of the second floatation member form a second closed loop.

The first closed loop may be configured to allow the person to insert their left lower arm into the first closed loop while gripping the first handle device with their left hand, and while standing upright in the region; and the second closed loop may be configured to allow the person to insert their right lower arm into the first closed loop while gripping the first handle device with their right hand, and while standing upright in the region.

The intermediate member may include a floatation device which floats substantially parallel to and on the surface of the water when the first floatation member and the second floatation member float parallel to and on the surface of the water. The intermediate member may be substantially perpendicular to the first floatation member and the second floatation member.

The first floatation member may be comprised of an elongated foam hollow cylinder which surrounds a plastic inner pipe; and the second floatation member may be comprised of an elongated foam hollow cylinder which surrounds a plastic inner pipe. The intermediate member may be comprised of an elongated foam hollow cylinder which surrounds a plastic inner pipe.

In at least one embodiment of the present invention a method is provided comprising the steps of placing an apparatus so that a first floatation member and a second floatation member of the apparatus float substantially parallel to and on the surface of water; gripping a first handle device of the apparatus with a left hand, and a second handle device of the apparatus with a right hand, while standing upright between the first floatation member and the second floatation member, and while the first handle device and the second handle device are under the surface of the water and the first and second floatation members float substantially parallel to and on the surface of the water; and walking on a ground surface while at least partially immersed in the water, and while gripping the first handle device with the left hand and the second handle device with the right hand.

DETAILED DESCRIPTION OF THE DRAWINGS

Figure 1:
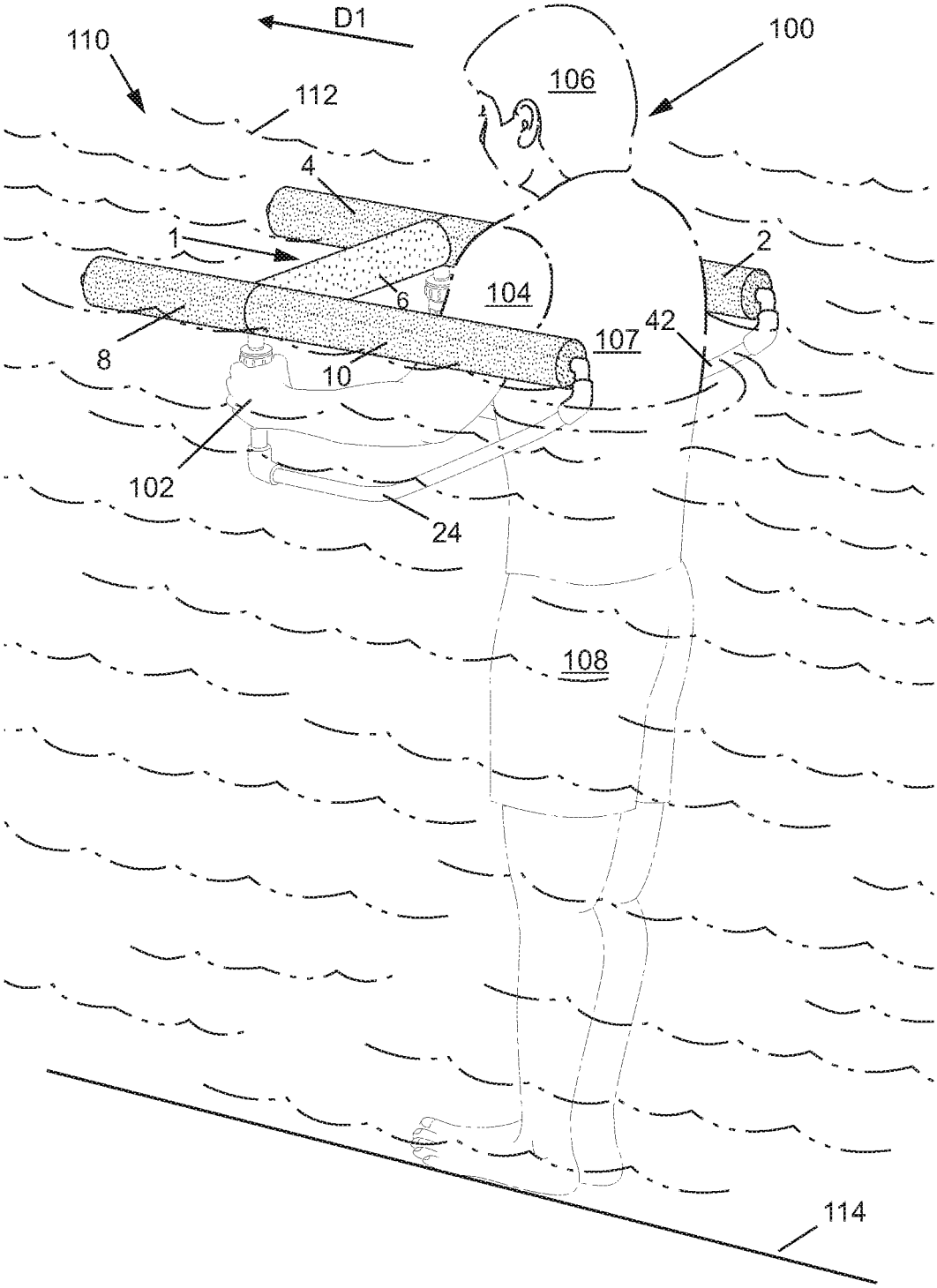
FIG. 1 shows a rear, right, and top perspective view of a floatation apparatus in accordance with the present invention, wherein the floatation apparatus is shown partially immersed in water, and partially floating on the surface of the water, and with a person shown holding the floatation apparatus, and standing, partially immersed in the water.

FIG. 1 shows a rear, right, and top perspective view of a floatation apparatus 1 in accordance with the present invention, wherein the floatation apparatus 1 is shown partially immersed in water 110, and partially floating on the surface of the water, and with a person 100 shown holding the floatation apparatus 1, and standing, partially immersed in the water 110.

FIGS. 2-8 show a rear, right, and top perspective view, a front elevational view, a rear elevational view, a left side elevational view, a right side elevational view, a top plan view, and a bottom view, respectively of the floatation apparatus 1 of FIG. 1.

Referring to FIGS. 1-8, the floatation apparatus 1, includes foam cylinders or noodles 2, 4, 6, 8, and 10, pipe 12, connector 14, handle or pipe 16, connector 18, connector or pipe 20, connector 22, pipe 24, connector 26, connector or pipe 28, pipe 9, pipe 30, connector 32, handle or pipe 34, connector 36, connector or pipe 38, connector 40, pipe 42, connector 44, connector or pipe 46, and pipe 3.

Figure 2:
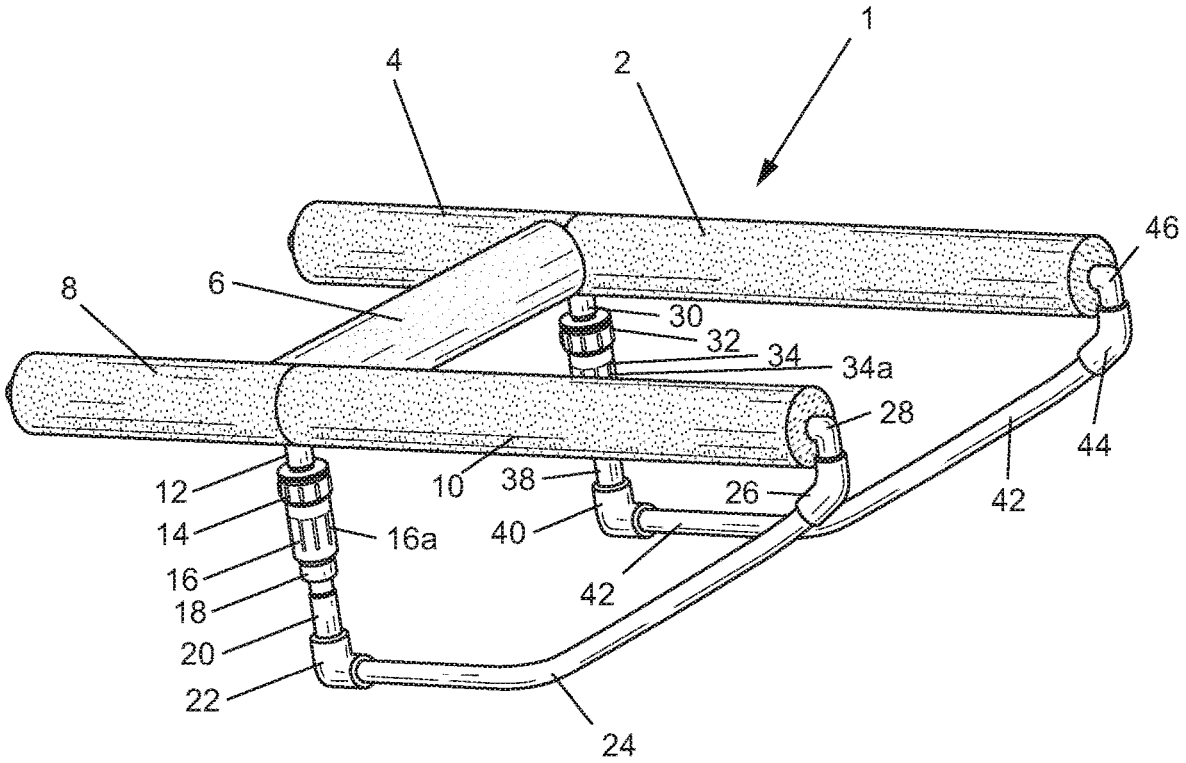
FIG. 2 shows a rear, right, and top perspective view of the floatation apparatus of FIG. 1.

The handle or pipe 16 may include a plurality of vertical ridges 16*a* shown in FIG. 2, which help to provide a secure grip for a left hand 102 of the person 100. Similarly or identically, the handle or pipe 34 may include a plurality of vertical ridges 34*a*, shown in FIG. 2, which help to provide a secure grip for a right hand, not shown of the person 100.

Figure 3:
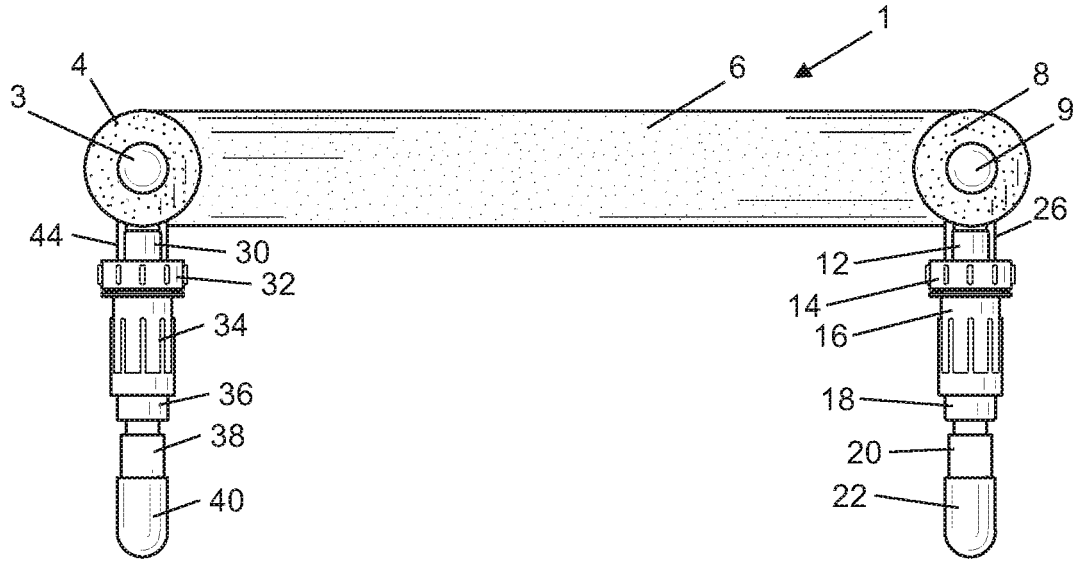
FIG. 3 shows a front elevational view of the floatation apparatus of FIG. 1.

Referring to FIG. 3, the pipe 9 is shown running or extending through the hollow center of the hollow cylinder foam 8. The pipe 9 extends from a first end at an opening of the hollow cylinder foam 8, as shown in FIG. 3, to a second opposing end connected to the connector or pipe 28. The pipe 9 thus extends, in a least one embodiment, typically all the way through the hollow center of foam 8 and foam 10.

The connector or pipe 28 is fixed to the connector or pipe 26, which is fixed to the pipe 24, which is fixed to the connector 22, which is fixed to the connector or pipe 20 which is fixed to the connector 18, which is fixed to the handle or pipe 16, which is fixed to the connector 14, which is fixed to the pipe 12.

The pipe 12 is fixed to the pipe 9, at a location between the first end and the second opposing end of the pipe 9, through an opening or junction between foams 8 and 10. At the same approximate location, the pipe 9 is fixed to a pipe, not shown which runs through a hollow center of the hollow foam cylinder 6. The pipe running through the hollow foam cylinder 6 is typically perpendicular to the pipe 9 and the pipe 3. The pipe running through the hollow foam cylinder 6 has a first end fixed to the pipe 9 and a second opposing end fixed to the pipe 3.

The connector or pipe 46 is fixed to the connector or pipe 44, which is fixed to the pipe 42, which is fixed to the connector 40, which is fixed to the connector or pipe 38 which is fixed to the connector 36, which is fixed to the handle or pipe 34, which is fixed to the connector 32, which is fixed to the pipe 30.

The pipe 30 is fixed to the pipe 3, at a location between the first end and the second opposing end of the pipe 3, through an opening or junction between foams 4 and 2. At the same approximate location, the pipe 3 is fixed to the pipe, not shown which runs through a hollow center of the hollow foam cylinder 6.

In operation, the person 100 places the apparatus 1 partially on and partially into the water 110 as shown FIG. 1. The apparatus 1 is placed so that the foam cylinders 2, 4, 6, 8, and 10 sit on and float on a surface 112 of the water 110. Thus pipe 9 within cylinders 8 and 10, pipe 3 within cylinders 2 and 4, and the pipe within cylinder 6, not shown, also are typically above the surface 112 of the water 110 in the state shown in FIG. 1.

As shown in FIG. 1, and in reference to FIG. 2, connectors 28 and 46 are typically above the surface 112 of the water 110. In addition, components 26, 24, 22, 20, 18, 16, 14, and 12 as well as components 44, 42, 40, 38, 36, 34, 32, and 30 are typically immersed in water.

The components 28, 26, 24, 22, 20, 18, 16, 14, and 12 as well as components 46, 44, 42, 40, 38, 36, 34, 32, and 30, and pipe 9, pipe 3, and the pipe within foam 6, may all be polyvinyl chloride (PVC) piping components. Approximately three quarters of an inch outer diameter pipe can be used for pipes or piping 9, 12, 20, 24, 28, and pipes or piping 3, 30, 38, 42, and 46, and for the inner pipe within foam cylinder 6. The components 14, 16, 18, 22, 26, and 32, 34, 36, 40, and 44 may be slightly larger than three quarters of an inch in outer diameter.

After the apparatus 1 is placed as in FIG. 1. The person 100, situates himself or herself, so that their head 106 is above the water surface 112 and between the foam cylinders 10 and 2; so that their upper torso is typically at least partially above the water surface 112 and between the foam cylinders 10 and 2; and so that their lower body 108 is fully immersed in the water 110 and between the foam cylinders 10 and 2. The person 100 then grips the handles 16 and 34 within his or her left and right hands, respectively, so that the left upper arm area 104 and the right upper arm area, not shown, are both typically between the foam cylinders 10 and 2, and the lower arms and hands are immersed in the water 110.

The individual 100 once situated as in FIG. 1, and while gripping the handles 16 and 34, then walks forward in the direction D1. The apparatus 1 helps individuals who cannot stand upright or walk in water without assistance. The individual 100 can also walk backwards in a direction opposite to D1, if desired.

In at least one embodiment, the combination of foam cylinders 8 and 10 and inner pipe 9 may be considered to be a first floatation member.

In at least one embodiment, the combination of foam cylinders 2 and 4 and inner pipe 3 may be considered to be a second floatation member.

In at least one embodiment, the handle or pipe 16 may be considered to be a first handle device or part of a first handle device, and the handle or pipe 34 may be considered to be a second handle device or part of a second handle device.

In at least one embodiment, the foam cylinder 6 and an inner pipe within the foam cylinder 6, which may be similar or identical to pipe 3 or 9, may be considered to be an intermediate member.

Figure 4:
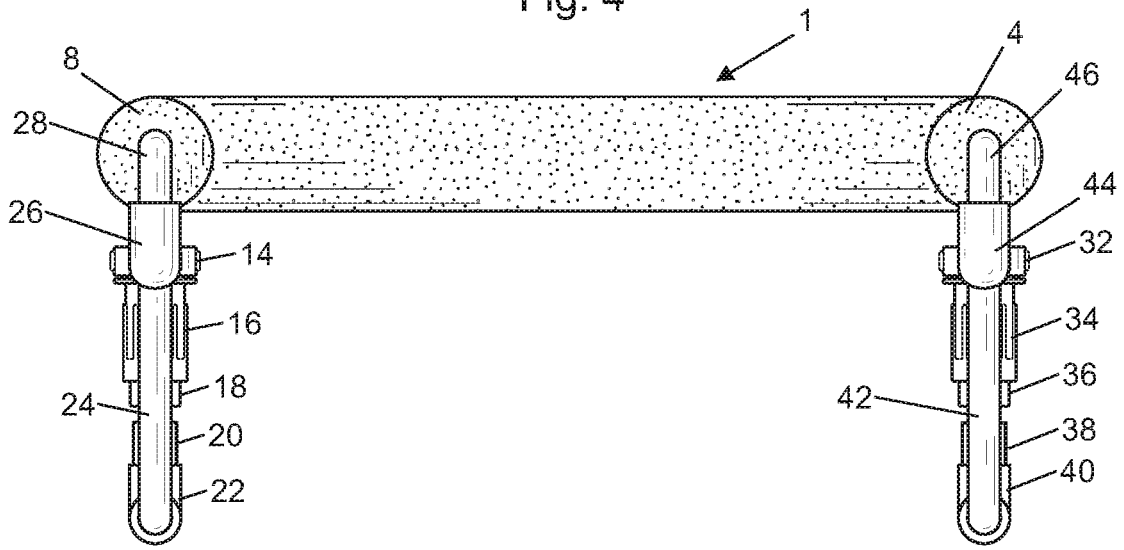
FIG. 4 shows a rear elevational view of the floatation apparatus of FIG. 1.

The handle devices, such as 16 and 34, may be fixed so they are perpendicular or substantially perpendicular to the first floatation member (which may include 8, 10, and 9); and the second floatation member (which may include 2, 4, and 3) as shown by FIGS. 3-4.

In at least one embodiment, the first end of the first handle device, such as 16 is fixed to a location between first and second ends of the first floatation member (which may include 8, 10, and 9), through components 12 and 14, and nearer the first end of the first floatation member (which may include 8, 10, and 9), and a second end of the first handle device 16 may fixed to first tubing, which may include components 18, 20, 22, 24, 26, and 28, which is fixed to the second end of the first floatation member (which may include 8, 10, and 9), and wherein the first tubing (18, 20, 22, 24, 26, and 28), first handle device 16, and at least part of the first floatation member (which may include 8, 10, and 9) form a first closed loop as shown in FIG. 2.

Figure 5:
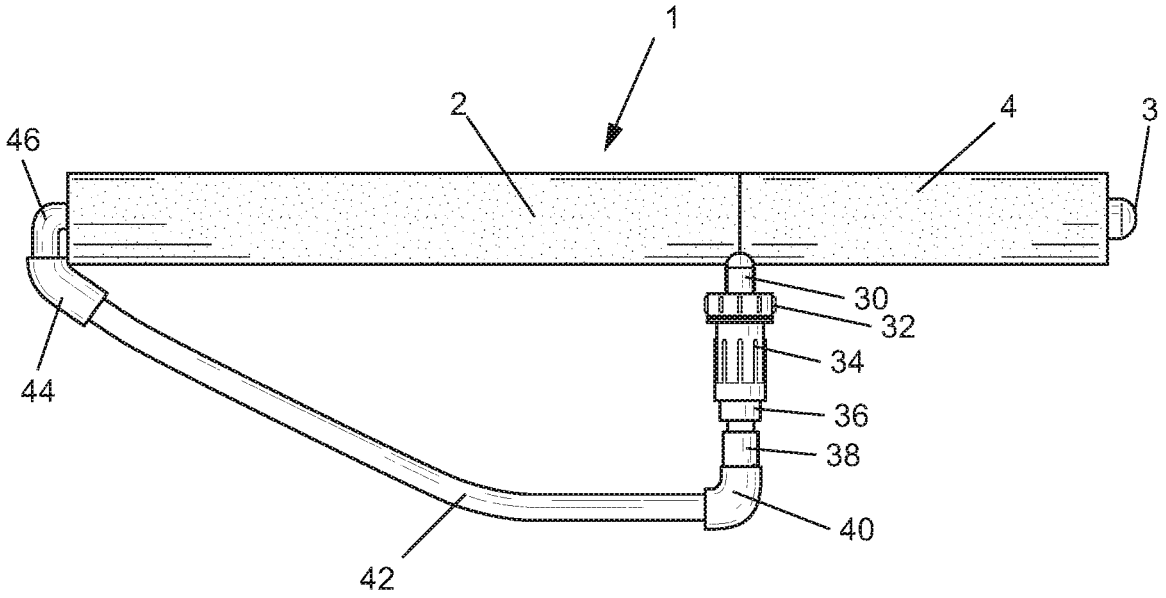
FIG. 5 shows a left side elevational view of the floatation apparatus of FIG. 1.
Figure 6:
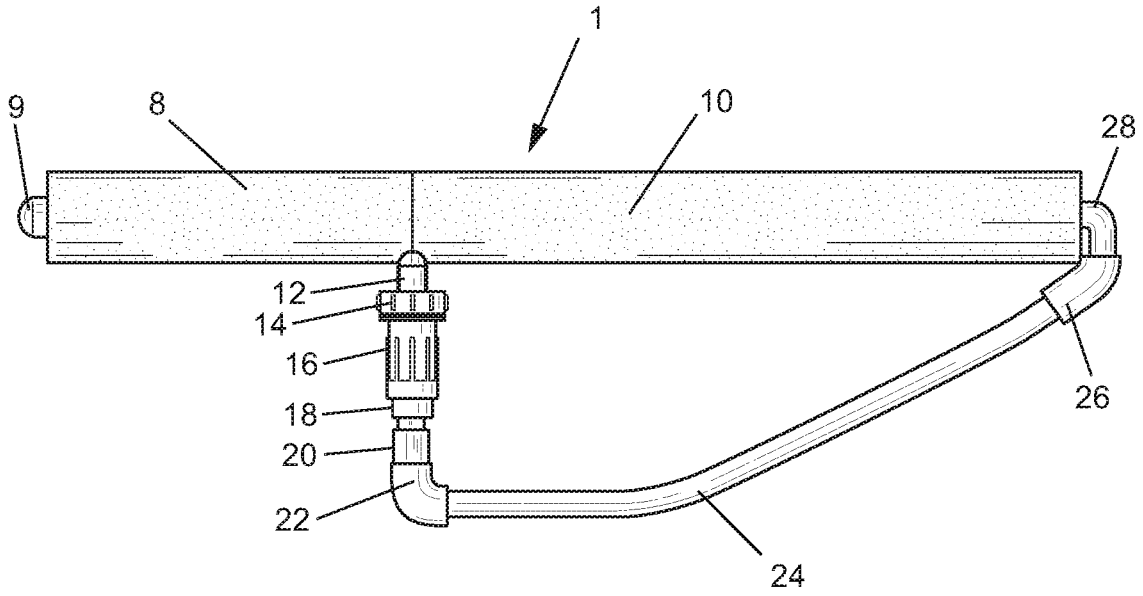
FIG. 6 shows a right side elevational view of the floatation apparatus of FIG. 1.
Figure 7:
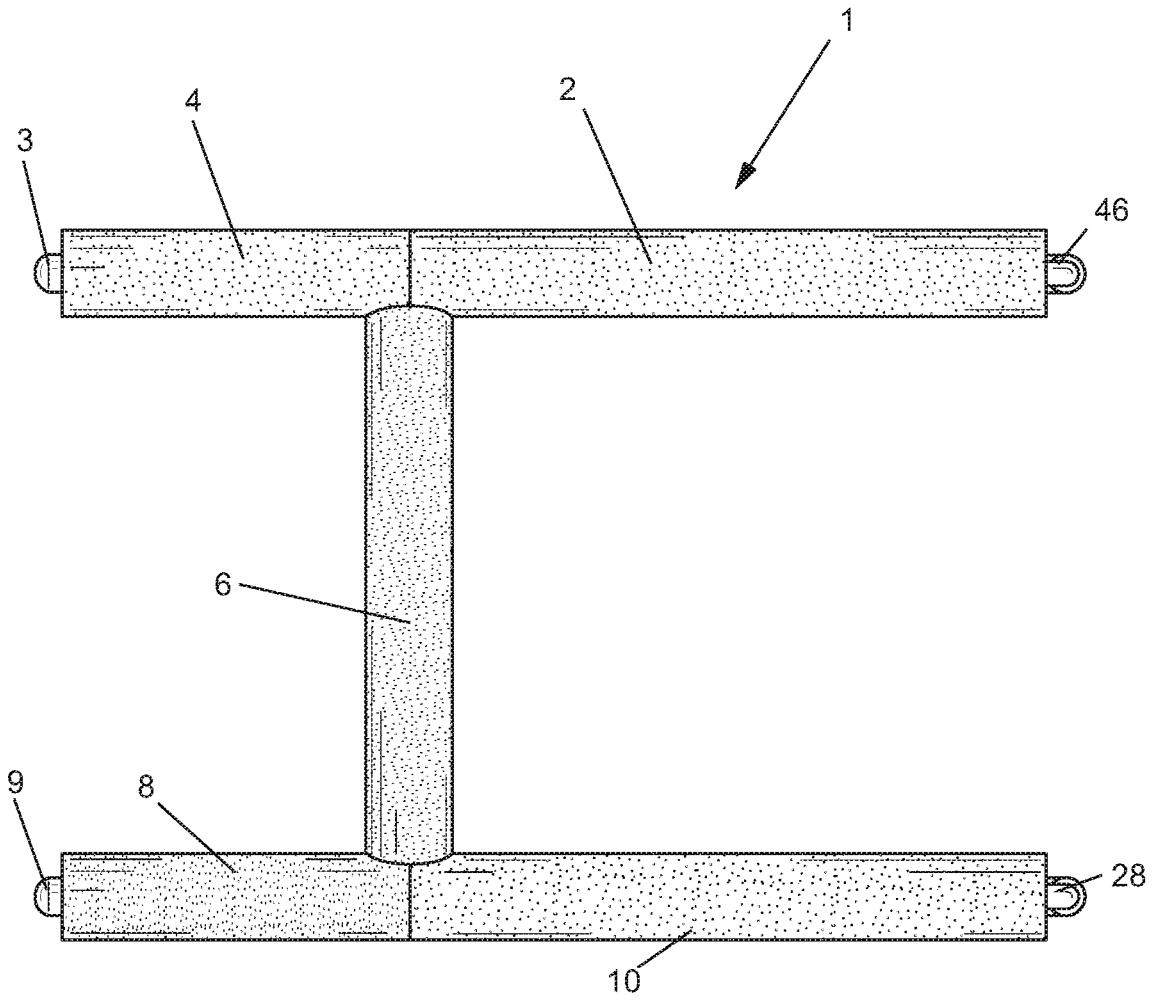
FIG. 7 shows a top plan view of the floatation apparatus of FIG. 1.
Figure 8:
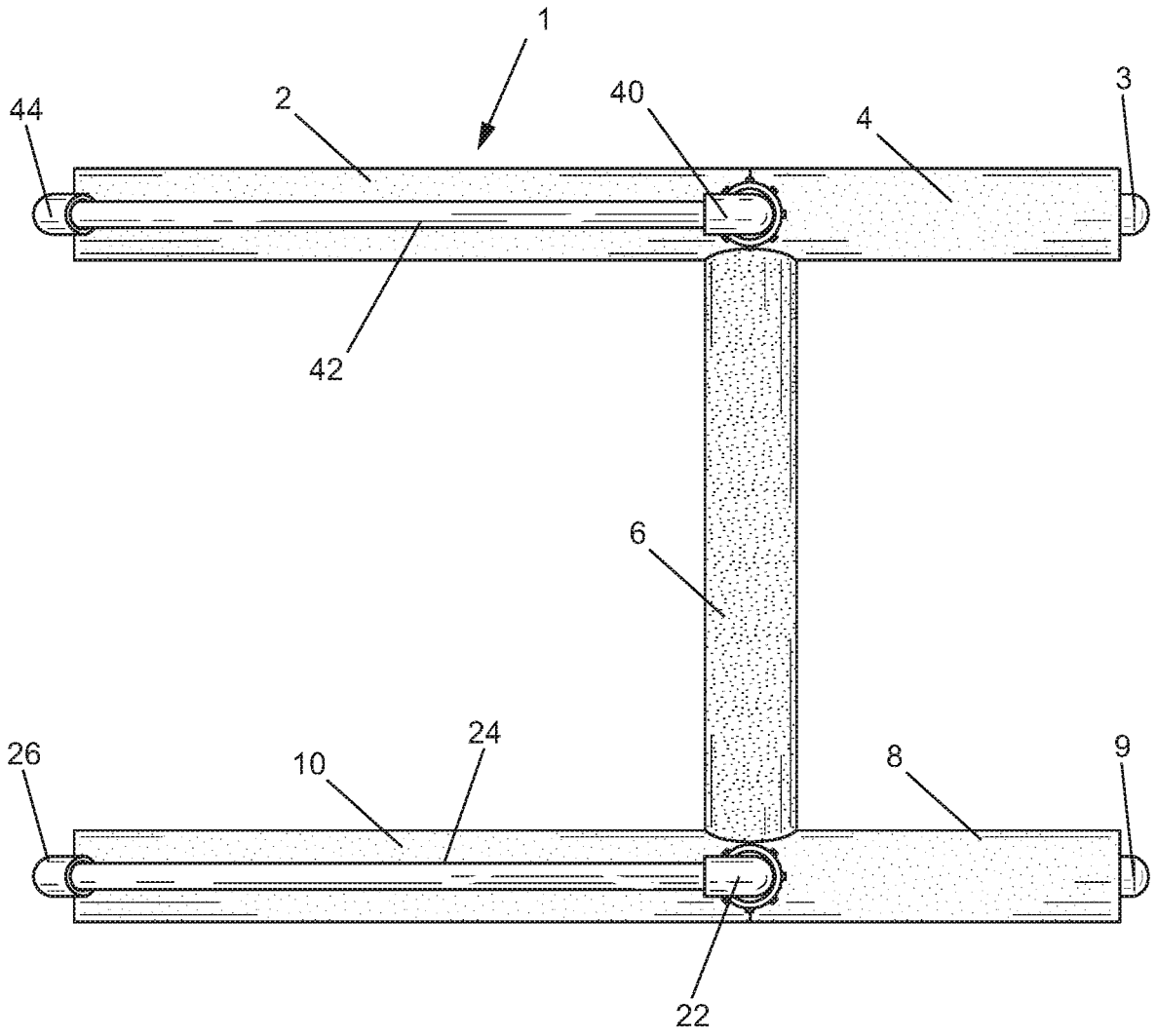
FIG. 8 shows a bottom view of the floatation apparatus of FIG. 1.

Similarly or identically, the first end of the second handle device 34 is fixed to a location between first and second ends of the second floatation member (which may include 2, 4, and 3), such as through components 30 and 32, and nearer the first end of the second floatation member (which may include 2, 4, and 3), and a second end of the second handle device 34 is fixed to second tubing (which may include 36, 38, 40, 42, 44, and 46) which is fixed to the second end of the second floatation member (which may include 2, 4, and 3), and wherein the second tubing (36, 38, 40, 42, 44, and 46), second handle device 34, and at least part of the second floatation member (2, 4, and 3) form a second closed loop as shown in FIG. 5).

The first closed loop is configured to allow the person 100 to insert their left lower arm into the first closed loop while gripping the first handle device 16 with their left hand 102, and while standing upright in the region between components 2 and 10.

The second closed loop is configured to allow the person 100 to insert their right lower arm into the second closed loop while gripping the second handle device 34 with their right hand, and while standing upright in the region between components 2 and 10.

In at least one embodiment, it is critical that the foam cylinders 2 and 10 be approximately the same length and be larger than the foam cylinders 4 and 8, and it is critical that the foam cylinders 4 and 8 be approximately the same length. Providing the same length for cylinders 2 and 10 and providing the same length for cylinders 4 and 8 provides balance to someone walking as shown in FIG. 1. Providing longer cylinders 2 and 10 versus shorter cylinders 4 and 8, provides support where a person stands, and reduces the amount of material needed.

Each of the foam cylinders 2 and 10 may be approximately two feet long and have an outer diameter of approximately three and one half inches. Each of the foam cylinders 4 and 8 may be approximately 1 foot long and have an outer diameter of approximately three and one half inches. The foam cylinder 6 may have a length of approximately two feet and a diameter of approximately three and one half inches. Cylinders 2, 4, 6, 2, and 18 may have an inner region with a diameter of approximately three quarters of an inch or slightly less to accommodate three quarters of an inch outer diameter pipe, with pipe 9 running from end to end, through an inner bore of cylinders 8 and 10; pipe 3 running from end to end, through the inner bore of cylinders 2 and 4, and a pipe similar or identical to pipes 3 and 9 running from end to end through an inner bore of cylinder 6.

In at least one embodiment, the intermediate member (which may include cylinder 6 and any inner pipe within cylinder 6), includes a floatation device which floats substantially parallel to and on the surface of the water when the first floatation member (which may include components 8, 10, and 9) and the second floatation member (which may include components 2, 4, and 3) float parallel to and on the surface of the water.

In at least one embodiment, the intermediate member (which may include cylinder 6, and any inner pipe within cylinder 6) is substantially perpendicular to the first floatation member (8, 10, and 9) and the second floatation member (2, 4, and 3).

In at least one embodiment, the first floatation member (8, 10, and 9) may be comprised of an elongated foam hollow cylinder (8 and 10) which surrounds a plastic inner pipe (9); and the second floatation member may be comprised of an elongated foam hollow cylinder (2, and 4) which surrounds a plastic inner pipe, such as 9. Similarly, the intermediate member may be comprised of an elongated foam hollow cylinder 6, which surrounds a plastic inner pipe, not shown.

In at least one embodiment, a method is provided of placing the apparatus 1 so that a first floatation member (such as 8, 10, and 9) and a second floatation member (2, 4, and 3) of the apparatus 1 float substantially parallel to and on the surface 112 of water 110; and gripping a first handle device 16 of the apparatus 1 with a left hand, and a second handle device 34 of the apparatus 1 with a right hand, while standing upright between the first floatation member (8, 10, and 9) and the second floatation member (2, 4, and 3), and while the first handle device 16 and the second handle device 34 are under the surface 112 of the water 110 and the first and second floatation members (8, 10, and 9 and 2, 4, and 3) float substantially parallel to and on the surface 112 of the 110 water; and walking on a ground surface 114, such as a ground surface of a swimming pool, while at least partially immersed in the water 110, and while gripping the first handle device 16 with the left hand and the second handle device 34 with the right hand.

In one or more embodiments, the drawings of the present invention disclose approximate relative dimensions, and the approximate relative dimensions are critical in one or more embodiments, however, the drawings are not drawn exactly to scale.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first floatation member;

a second floatation member;

a first handle device fixed at a first end to the first floatation member;

a second handle device fixed at a first end to the second floatation member;

and an intermediate member; and wherein the first floatation member is connected to the second floatation member by the intermediate member, so that there is a region between the first floatation member and the second floatation member, and behind the intermediate member;

wherein the first handle device and the second handle device are configured to be situated below the surface of water, when the first floatation member and the second floatation member are floating substantially parallel to and on the surface of the water;

wherein the apparatus is configured so that a person can stand upright in the region and simultaneously grip the first and second handle devices, with first and second hands, respectively, while the first floatation member and the second floatation member float, substantially parallel to and on the surface of the water;

wherein the first end of the first handle device is fixed to a location between first and second ends of the first floatation member, and nearer the first end of the first floatation member, and a second end of the first handle device is fixed to first tubing which is fixed to the second end of the first floatation member, and wherein the first tubing, first handle device, and at least part of the first floatation member form a first closed loop; and the first end of the second handle device is fixed to a location between first and second ends of the second floatation member, and nearer the first end of the second floatation member, and a second end of the second handle device is fixed to second tubing which is fixed to the second end of the second floatation member, and wherein the second tubing, second handle device, and at least part of the second floatation member form a second closed loop.

2. The apparatus of claim 1 wherein the first handle device is substantially perpendicular to the first floatation member; and the second handle device is substantially perpendicular to the second floatation member.

3. The apparatus of claim 1 wherein the first closed loop is configured to allow the person to insert their left lower arm into the first closed loop while gripping the first handle device with their left hand, and while standing upright in the region; and the second closed loop is configured to allow the person to insert their right lower arm into the first closed loop while gripping the first handle device with their right hand, and while standing upright in the region.

4. The apparatus of claim 1 wherein the intermediate member includes a floatation device which floats substantially parallel to and on the surface of the water when the first floatation member and the second floatation member float parallel to and on the surface of the water.

5. The apparatus of claim 1 wherein the intermediate member is substantially perpendicular to the first floatation member and the second floatation member.

6. The apparatus of claim 5 wherein the intermediate member is comprised of an elongated foam hollow cylinder which surrounds a plastic inner pipe.

7. The apparatus of claim 1 wherein the first floatation member is comprised of an elongated foam hollow cylinder which surrounds a plastic inner pipe; and the second floatation member is comprised of an elongated foam hollow cylinder which surrounds a plastic inner pipe.

8. A method comprising the steps of:

placing an apparatus so that a first floatation member and a second floatation member of the apparatus float substantially parallel to and on the surface of water; and gripping a first handle device of the apparatus with a left hand, and a second handle device of the apparatus with a right hand, while standing upright between the first floatation member and the second floatation member, and while the first handle device and the second handle device are under the surface of the water and the first and second floatation members float substantially parallel to and on the surface of the water; and walking on a ground surface while at least partially immersed in the water, and while gripping the first handle device with the left hand and the second handle device with the right hand;

wherein the first handle device is fixed at a first end to the first floatation member;

wherein the second handle device is fixed at a first end to the second floatation member;

wherein the first floatation member is connected to the second floatation member by an intermediate member, so that there is a region between the first floatation member and the second floatation member, and behind the intermediate member, where a person can stand upright, and simultaneously grip the first and second handle devices, with the left and the right hands, respectively, and walk upright, while the first floatation member and the second floatation member float, substantially parallel to and on the surface of the water;

wherein the first end of the first handle device is fixed to a location between first and second ends of the first floatation member, and nearer the first end of the first floatation member, and a second end of the first handle device is fixed to first tubing which is fixed to the second end of the first floatation member, and wherein the first tubing, first handle device, and at least part of the first floatation member form a first closed loop; and the first end of the second handle device is fixed to a location between first and second ends of the second floatation member, and nearer the first end of the second floatation member, and a second end of the second handle device is fixed to second tubing which is fixed to the second end of the second floatation member, and wherein the second tubing, second handle device, and at least part of the second floatation member form a second closed loop.

9. The method of claim 8 wherein the first handle device is substantially perpendicular to the first floatation member; and the second handle device is substantially perpendicular to the second floatation member.

10. The method of claim 8 wherein the first closed loop is configured to allow the person to insert their left lower arm into the first closed loop while gripping the first handle device with their left hand, and while standing upright in the region; and the second closed loop is configured to allow the person to insert their right lower arm into the first closed loop while gripping the first handle device with their right hand, and while standing upright in the region.

11. The method of claim 8 wherein the intermediate member includes a floatation device which floats substantially parallel to and on the surface of the water when the first floatation member and the second floatation member float parallel to and on the surface of the water.

12. The method of claim 8 wherein the intermediate member is substantially perpendicular to the first floatation member and the second floatation member.

13. The method of claim 12 wherein the intermediate member is comprised of an elongated foam hollow cylinder which surrounds a plastic inner pipe.

14. The method of claim 8 wherein the first floatation member is comprised of an elongated foam hollow cylinder which surrounds a plastic inner pipe; and the second floatation member is comprised of an elongated foam hollow cylinder which surrounds a plastic inner pipe.

* * * * *